US008975823B2

(12) United States Patent
Yang et al.

(10) Patent No.: US 8,975,823 B2
(45) Date of Patent: Mar. 10, 2015

(54) LED CONTROL APPARATUS

(71) Applicant: Just Power Integrated Technology Inc., New Taipei (TW)

(72) Inventors: Ching-Nan Yang, New Taipei (TW); Chin-Hui Kuo, New Taipei (TW)

(73) Assignee: Just Power Integrated Technology Inc., New Taipei (TW)

( * ) Notice: Subject to any disclaimer, the term of this patent is extended or adjusted under 35 U.S.C. 154(b) by 78 days.

(21) Appl. No.: 13/831,937

(22) Filed: Mar. 15, 2013

(65) Prior Publication Data

US 2014/0265902 A1 Sep. 18, 2014

(51) Int. Cl.
*H05B 33/08* (2006.01)

(52) U.S. Cl.
CPC ..... *H05B 33/0857* (2013.01)
USPC ..... 315/201; 315/294

(58) Field of Classification Search
CPC ..... H05B 33/0803
USPC ..... 315/185 R, 291, 292, 297, 307, 201, 294
See application file for complete search history.

(56) References Cited

U.S. PATENT DOCUMENTS

| | | | | |
|---|---|---|---|---|
| 2010/0219770 | A1* | 9/2010 | Kim et al. | 315/294 |
| 2012/0098460 | A1* | 4/2012 | Miyasaka et al. | 315/294 |
| 2012/0146544 | A1* | 6/2012 | Sauerlaender et al. | 315/294 |
| 2013/0063035 | A1* | 3/2013 | Baddela et al. | 315/192 |
| 2013/0093357 | A1* | 4/2013 | Lee et al. | 315/297 |
| 2013/0207559 | A1* | 8/2013 | Ferrier | 315/192 |

* cited by examiner

*Primary Examiner* — Douglas W Owens
*Assistant Examiner* — Pedro C Fernandez
(74) *Attorney, Agent, or Firm* — Leong C. Lei

(57) ABSTRACT

Provided is an LED control apparatus for controlling a color temperature of at least one LED light module, and the LED control apparatus includes an LED driver electrically connected to the LED light modules; a power conversion module; and a microcontroller unit electrically connected to the power conversion module to control a current output ratio of the LED driver; the microcontroller unit comprises a first control point connected to the LED driver and second and third control points connected to the LED modules; wherein the second and third control points are electrically connected to current controllers for controlling a current therethrough. By using the microcontroller connected to the LED driver to control the current outputs to the LED light modules, the current ratio of the LED light modules can be effectively controlled in order to change the color temperatures of the LED light modules.

5 Claims, 4 Drawing Sheets

LED CONTROL APPARATUS

TECHNICAL FIELD OF THE INVENTION

The present invention is related to an LED control apparatus, more particularly, to an LED control apparatus utilizing an LED driver capable of controlling the amount of the current output ratio at an output end thereof in order to achieve the color temperature changes of illuminated LED light modules connected thereto.

DESCRIPTION OF THE PRIOR ART

As lighting fixtures and lights play a significant role in our daily lives, it is found that according to various conditions including the time, place and environment, different degrees of luminance and color temperatures of the lighting fixtures are required to obtain optimal lighting effects and feels. In other words, a light source illuminated at a certain color temperature is able to achieve a particular atmosphere while providing a completely different person feeling to the surrounding of the light, which may include soothing and comforting feelings of a person under a certain color temperature of the light. For example, the light shone to have a color temperature below 3000K is likely to provide warm and relax feelings to the person receiving such light; whereas, the light of a color temperature above 6000K is generally used to obtain greater brightness in most working places and related working environment.

It is known that the use of a lighting fixture equipped with a dimmer function can be not only energy-saving but also useful in obtaining various types of lighting effects for different applications of the lighting fixture. However, under normal practices, different light sources with different color temperatures must be provided and installed onto a lighting fixture in order to achieve the color temperature changes from the light fixture; and in most cases, different light sources of unequal color temperatures must be controlled separately by at least two distinct lighting circuits, which tends to cause the problem to common households as such new and unfitted lighting circuits need to be incorporated into the existing ones with the current lighting fixtures; therefore, the costs of such artificial light fixtures are likely to increase significantly. In other words, such type of lighting fixtures cannot satisfy the needs of common users that demand lights to have different color temperatures and to be set according to various conditions and environment desired.

In view of the above, the inventor of the present invention seeks to provide an improvement to overcome the aforementioned drawbacks associated with the known arts after years of research and development in the field.

SUMMARY OF THE INVENTION

A primary objective of the present invention is to provide an LED control apparatus that utilizes a microcontroller unit (MCU) electrically connected to an LED driver on one end thereof to control an LED light source at an output end thereof in order to effectively control the current ratio guided into each one of the LED light modules and such that the color temperature of the light shone therefrom can be changed accordingly.

To achieve the aforementioned objective, the present invention provides an LED control apparatus for controlling a color temperature of at least one LED light module, and the LED control apparatus comprises an LED driver electrically connected to the at least one LED light module; a power conversion module; and a microcontroller unit electrically connected to the power conversion module to control a current output ratio of the LED driver; wherein the microcontroller unit comprises a first control point electrically connected to the LED driver and at least one second control point and at least one third control point electrically connected to the at least one LED module; and wherein the at least one second control point and the at least one third control point are electrically connected to at least one current controller for controlling a current therethrough. Accordingly, as the LED control apparatus of the present invention is electrically connected to the LED light modules, the municipal electricity on grid transmits power to the power conversion module and the LED driver for activation thereof, which is too being controlled by the microcontroller unit to adjust the current flow ratio guided therein in order to provide the necessary current specifically required by the LED lighting fixtures under different settings. By using the microcontroller unit and by electrically connecting one end of the microcontroller unit to the LED driver having the LED light modules electrically connected to the output end thereof, the luminance of the LED light modules can be controlled individually at the output ends thereof and the color temperature of the light of such LED fixtures at work can be changed such that the technical effects of providing illumination lighting with different color temperatures according to the needs of different applications and settings can be advantageously achieved.

DETAILED DESCRIPTION OF THE PREFERRED EMBODIMENTS

Figure 1:
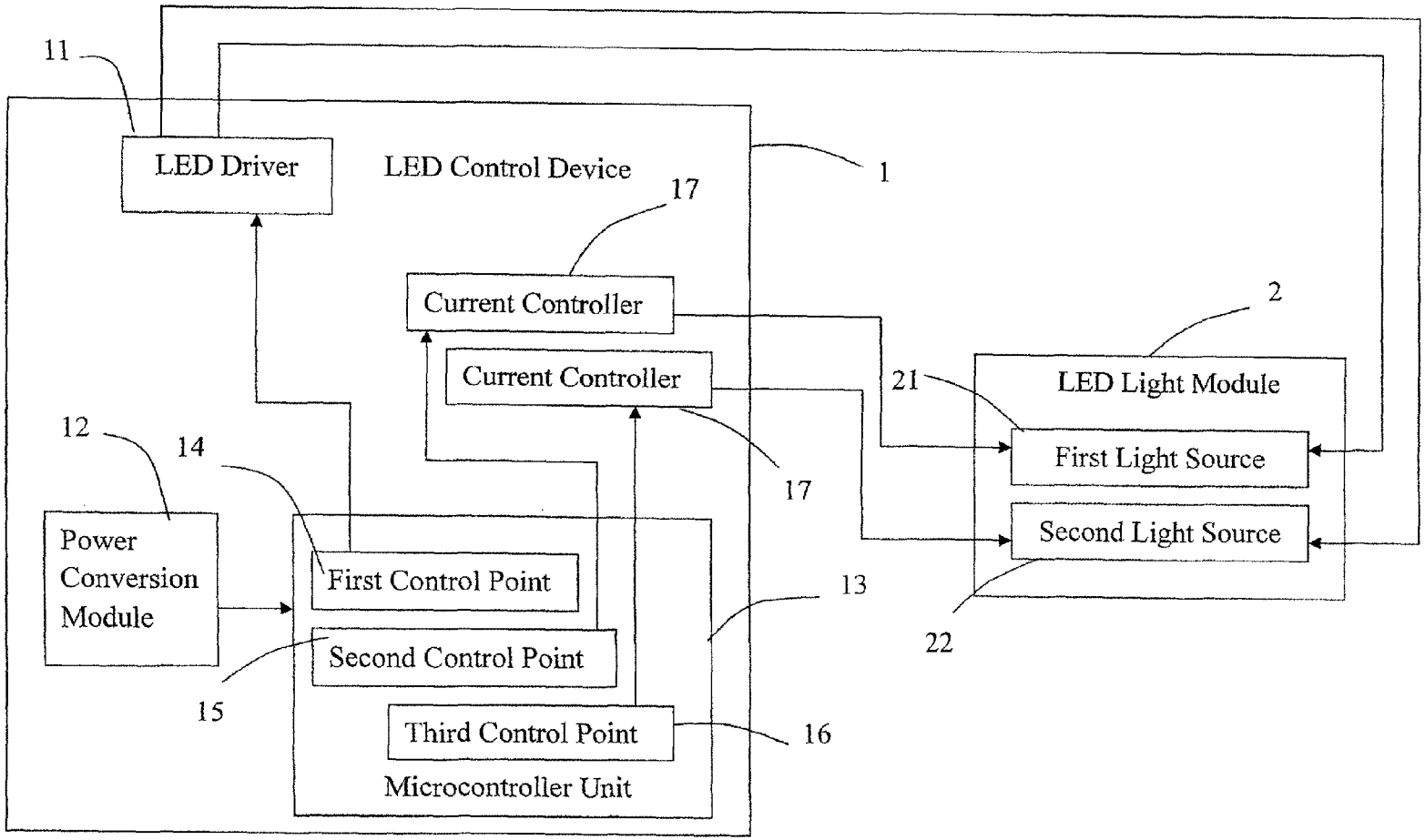
FIG. 1 is a block diagram of a preferred embodiment of an LED control apparatus of the present invention.
Figure 2:
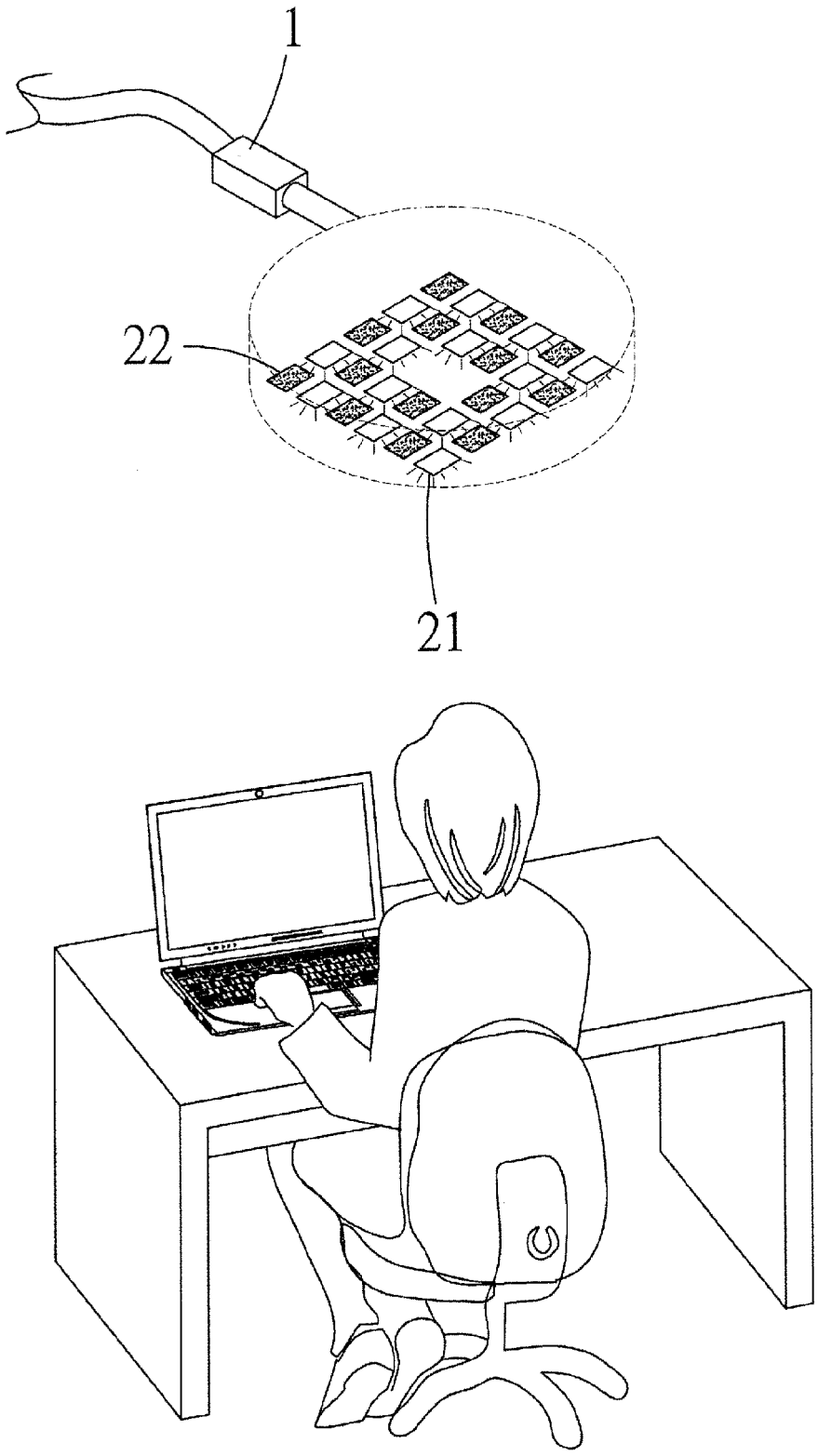
FIG. 2 is a first illustration showing a state of use of the preferred embodiment of the LED control apparatus of the present invention.
Figure 3:
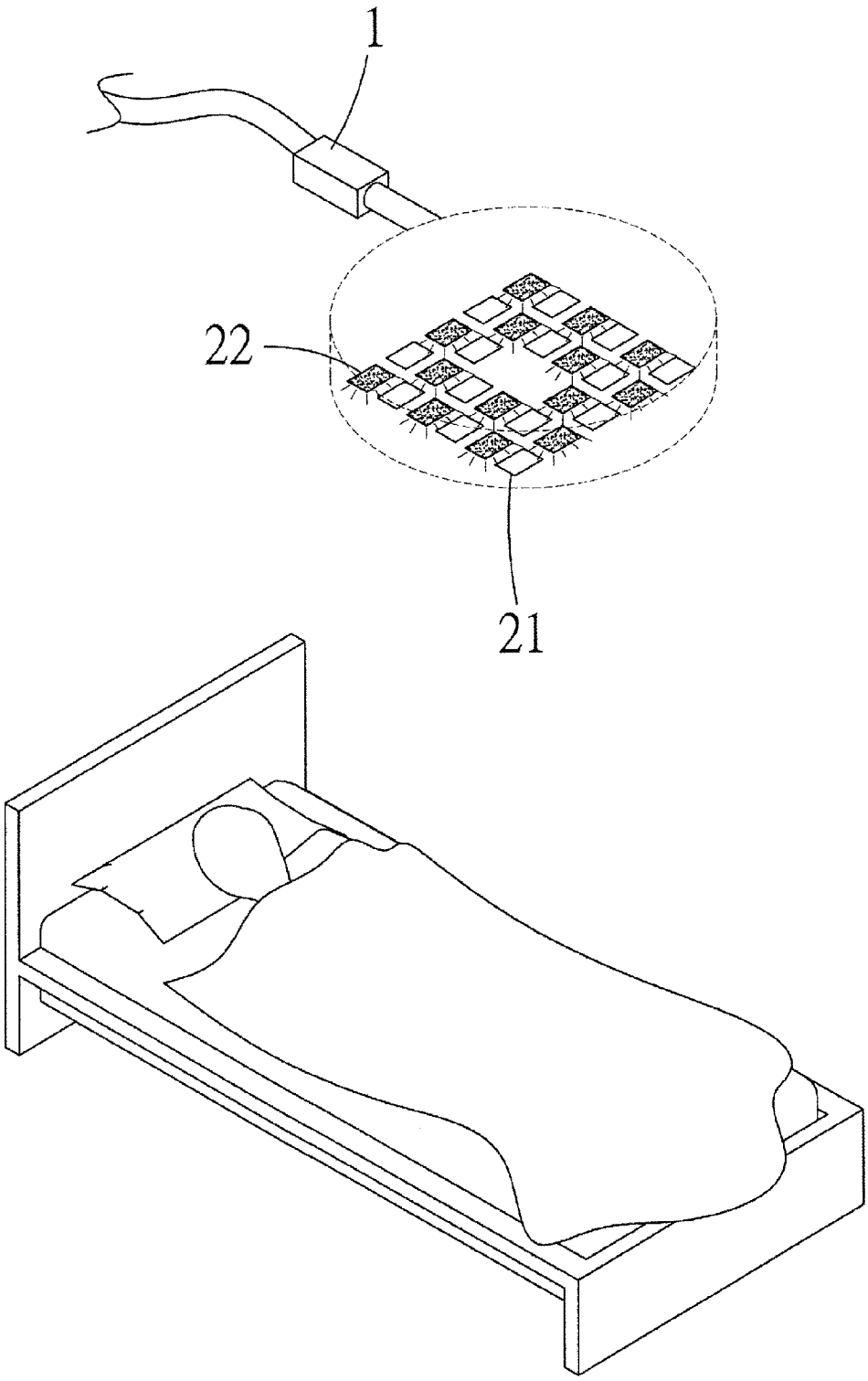
FIG. 3 is a second illustration showing another state of use of the preferred embodiment of the LED control apparatus of the present invention.
Figure 4:
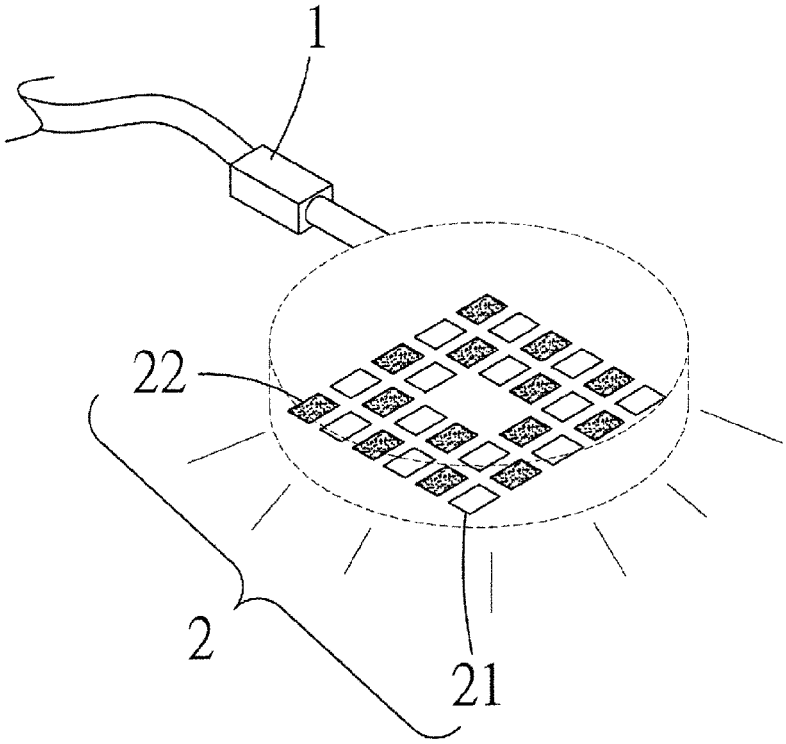
FIG. 4 is a third illustration showing another state of use of the preferred embodiment of the LED control apparatus of the present invention.
Figure 4:
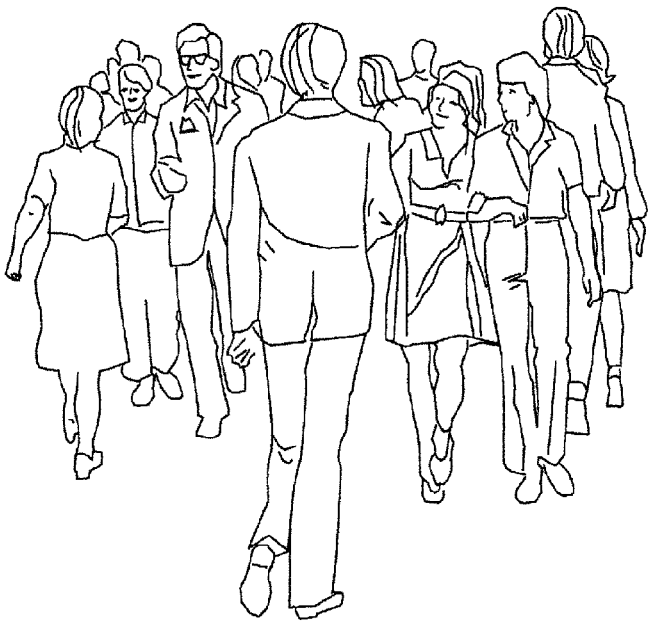

Please refer to FIG. 1 showing a preferred embodiment of an LED control apparatus of the present invention. As shown in the figure, the LED control apparatus of the present invention for controlling a color temperature change of at least one LED light module 2, wherein the LED control apparatus 1 comprises:

an LED driver 11 electrically connected to the at least one LED light module 2;

a power conversion module 12; and a microcontroller unit 13 electrically connected to the power conversion module 12 to control a current output ratio of the LED driver 11; wherein the microcontroller unit 13 comprises a first control point 14 electrically connected to the LED driver 11 and at least one second control point 15 and at least one third control point 16 electrically connected to the at least one LED module 2; and at least one current controller 17 for controlling a current therethrough is electrically connected between the at least one second control point 15 with the at least one third control point 15 and the at least one LED light module 12.

According to the aforementioned LED control apparatus of the present invention, the at least one LED light module 2 further comprises a first light source 21 and a second light source 22; wherein the first light source is a white-light LED of a color temperature substantially equivalent to 6000K to shine a cold white light, and the second light source is another white-light LED of a color temperature substantially equivalent to 3000K to shine a warm white light. In addition, the at least one current controller 17 is a metal-oxide-semiconductor field effect transistor (MOSFET).

Please refer to FIG. 1~FIG. 4 showing a block diagram and illustrations of different states of uses of the LED control apparatus of the preferred embodiment of the present invention. As shown in the figures, during an operation of the present invention, the LED control apparatus 1 is able to use the power conversion module 12 to convert an AC power input by the municipal electricity on grid to a DC power output thereof. In addition, the LED control apparatus 1 of the present invention is able to control the activation of the LED driver via the first control point 14 in order to achieve the control of the LED modules 2 advantageously. During the implementation and operation thereof, the LED modules 2 are further defined with a first light source 21 and a second light source 22. The condition of the operation of the components of the present invention cooperating with each other is further described in details. The first light source 21 is defined to be a cold white light source having a higher color temperature greater than 4000K, preferably such as 6000K; whereas the second light source 22 can be defined to be a warm white light source having a lower color temperature less than 4000K, preferably such as 3000K. Based on the above, the following provides an illustrative example to demonstrate the use of the microcontroller unit 13 electrically connected to the current controller 17 on one end thereof to adjust the current output to the first light source 21 and the second light source 22 during the time when the current is output and guided therein. The table below is also provided for illustrative purposes only:

| Total current at the output end controlled by the first control point | Second control point | Current of the first light source | Third control point | Current of the second light source |
|---|---|---|---|---|
| 300 mA | on | 300 mA | off | 0 mA |
| | off | 0 mA | on | 300 mA |
| | on | ~150 mA | on | ~150 mA |
| 200 mA | on | 200 mA | off | 0 mA |
| | off | 0 mA | on | 200 mA |
| | on | ~100 mA | on | ~100 mA |
| 100 mA | on | 100 mA | off | 0 mA |
| | off | 0 mA | on | 100 mA |
| | on | ~50 mA | on | ~50 mA |

The above table shows that when the second control point 15 is at an ON state while at the same time, the third control point 16 is at an OFF state, the first light source 21 obtains a portion of the current of an amount of 300 mA, which makes the second light source 22 to obtain a portion of the current of an amount of 0 mA ; and during which, the first light source 21 shines light of a color temperature of 6000K or a cold white light suitable to working environment. On the other hand, when the second control point 15 is at an OFF state while at the same time, the third control point 16 is at an ON state, then the first light source 21 obtains a portion of the current of an amount of 0 mA, which causes the second light source 22 to obtain a portion of the current of an amount of 300 mA; and during which, the second light source 22 shines light of a color temperature of 3000K or a warm white light suitable to generate a relaxing and comforting feeling. If the first light source 21 obtains a portion of the current of an amount of 150 mA while a portion of the current passing through the second light source 22 is also of an amount of 150 mA, then light of mixing color temperatures can be obtained to achieve the effect of a mixed lighting. The opposite of the above can also be realized and easily inferred, and the rest of the occurrences in which different portions of the current are involved can too be understood without further elaborations. As a result, the LED control apparatus of the present invention mainly uses the microcontroller unit 13 to electrically connect to the current controller 17 on one end thereof to adjust the current ratio of the current outputs to the first light source 21 and the second light source 22 such that the first light source 21 and the second light source 22 can shine lights of different color temperatures to advantageously produce a mixed lighting at different color temperatures, color gradient and brightness.

In view of the above, the LED control apparatus of the present invention is of an improved technical feature that relies mainly on:

The utilization of the microcontroller 13 electrically connected to the LED driver 11 on one end thereof to control the current outputs to the LED light sources electrically connected to the output end thereof such that the current ratio of the LED light module 2 can be effectively controlled in order to change the color temperature (color) of the LED light module 2.

What is claimed is:

1. An LED control apparatus for controlling a color temperature change of at least one LED light module, said LED control apparatus comprising:

an LED driver electrically connected to said at least one LED light module;

a power conversion module; and a microcontroller unit electrically connected to said power conversion module to control a current output ratio of said LED driver; wherein said microcontroller unit comprises a first control point electrically connected to said LED driver and at least one second control point and at least one third control point electrically connected to said at least one LED module; and wherein said at least one second control point and said at least one third control point are electrically connected to at least one current controller for controlling a current therethrough, the second control point and the third control point being each switchable between two conditions so as to provide different levels of the currents flowing through the second and third control points.

2. The LED control apparatus according to claim 1, wherein said power conversion module is configured to convert an AC power to a DC power.

3. The LED control apparatus according to claim 1, wherein said at least one LED light module further comprises a first light source and a second light source.

4. The LED control apparatus according to claim 3, wherein said first light source is a white-light LED of a color temperature substantially equivalent to 6000K to shine a cold white light, and said second light source is another white-light LED of a color temperature substantially equivalent to 3000K to shine a warm white light.

5. The LED control apparatus according to claim 1, wherein said at least one current controller is a metal-oxide-semiconductor field effect transistor.

* * * * *